United States Patent [19]

Zahoran

[11] 4,089,501

[45] May 16, 1978

[54] BULLET MOLD

[76] Inventor: George Zahoran, 1906 Doren St., S. El Monte, Calif. 91733

[21] Appl. No.: 764,398

[22] Filed: Jan. 31, 1977

[51] Int. Cl.[2] ..... B22C 9/22; B22D 25/02

[52] U.S. Cl. ..... 249/171; 164/262

[58] Field of Search ..... 164/262; 249/110, 102, 249/161, 165, 170, 171, 108

[56] References Cited

U.S. PATENT DOCUMENTS

| | | | |
|---|---|---|---|
| 904,273 | 11/1908 | Mundt | 249/161 X |
| 1,493,911 | 5/1924 | Washburn | 249/170 |
| 3,749,351 | 7/1973 | Lee | 249/170 |
| 3,870,272 | 3/1975 | Jackman | 249/170 |

*Primary Examiner*—Francis S. Husar
*Assistant Examiner*—John S. Brown
*Attorney, Agent, or Firm*—Poms, Smith, Lande & Glenny

[57] ABSTRACT

A mold for casting bullets comprising a plurality of adjacent mold blocks having paired opposing cavity portions within opposing lateral surfaces of adjacent blocks for forming casting cavities when the mold is closed and the opposing lateral surfaces are in contact has interlocking means at least partially integral of the adjacent blocks for providing a sliding surface contact for the block during pivotal movement thereof and for limiting relative movement between the blocks to arcuate separation and closure of the adjacent blocks in a plane which is perpendicular to the opposing lateral surfaces of the blocks. Means integral of the opposing lateral surfaces of adjacent blocks provide at least one pivot center of arcuate separation and closure between the adjacent blocks and means are provided for retaining at least a portion of the opposing lateral surfaces of adjacent blocks in contact during the arcuate separation and closure of the blocks.

10 Claims, 8 Drawing Figures

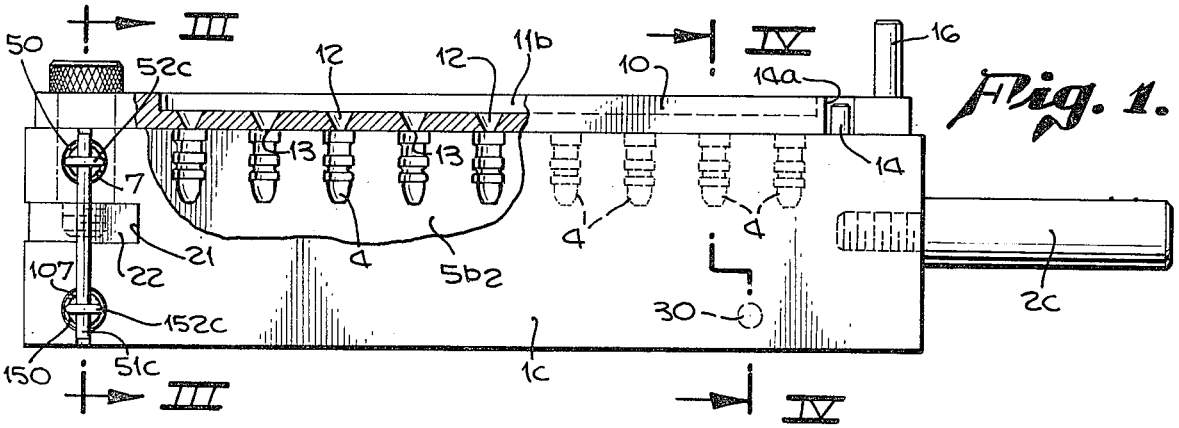
Fig. 1.
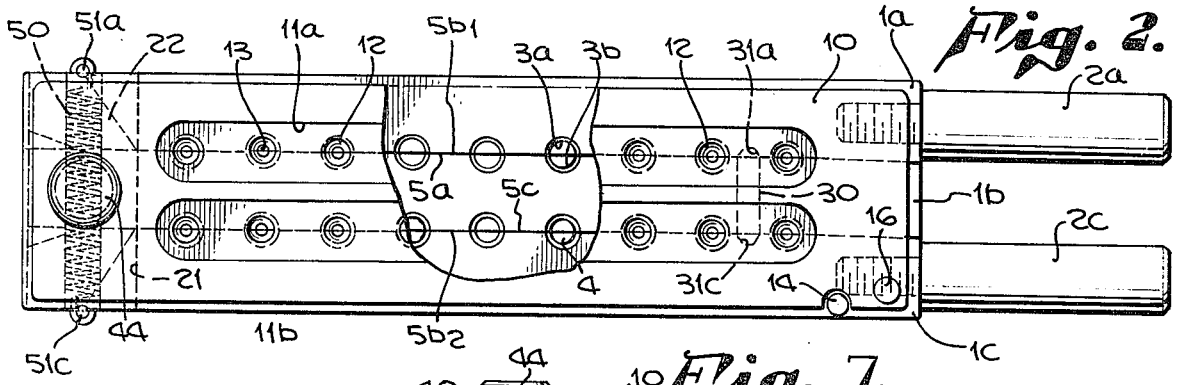
Fig. 2.
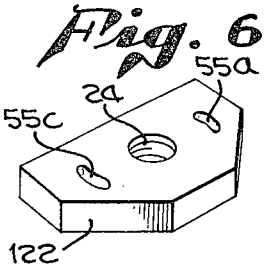
Fig. 6a
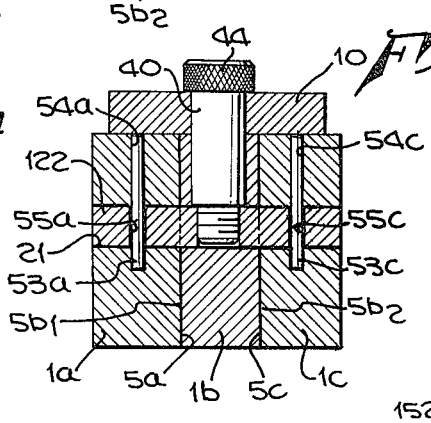
Fig. 7.
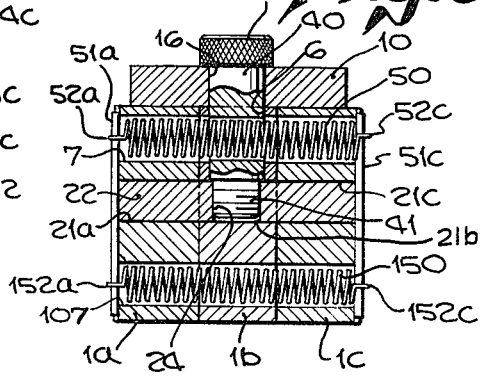
Fig. 3.
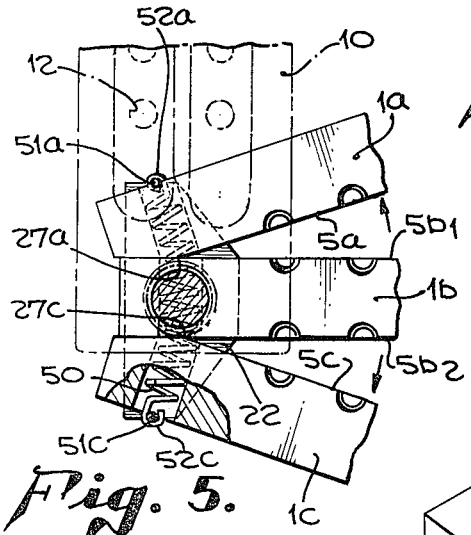
Fig. 5.
Fig. 6.
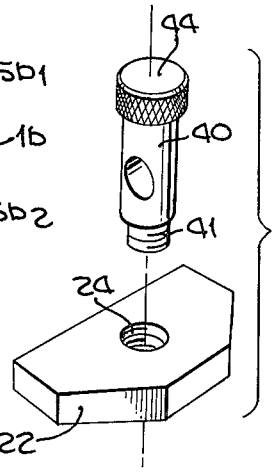
Fig. 4.
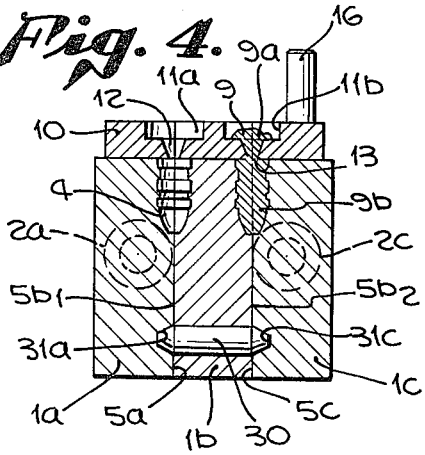

BULLET MOLD

BACKGROUND OF THE INVENTION

The present invention relates in general to molds for casting bullets. More particularly, the present invention relates to bullet molds having a plurality of mold cavities arranged in a plurality of adjacent rows of mold cavities formed between the opposing lateral surface of adjacent mold blocks.

Prior art bullet molds have generally been limited to a single row or bullet casing cavities from between opposing lateral surfaces of a pair of adjacent blocks. In general, the opposing mold blocks are secured to a handle apparatus having a scissor hinge as is shown in U.S. Pat. No. 1,763,977, McNeely and U.S. Pat. No. 3,745,873, Lee.

In devices which do not utilize the scissors hinge, mold blocks are secured to a device having handles at one end and a hinge at a distal end of the device. Exemplary of this manner of joining mold blocks is U.S. Pat. No. 2,380,751, Gowland.

These general approaches to the problem of connecting and operating mold blocks have proven satisfactory so long as the mold itself comprises a single row of mold cavities formed between two adjacent mold blocks. However, due to the requirement of volume production, it is desirable, in certain applications, to provide a plurality of parallel rows of cavities. This approach is desirable in that it allows the fabrication of a mold having a center of mass which is closer to the handles of the mold than a mold having a similar number of cavities arranged in one single extended row, as it reduces the fatique of the operator during the use of the mold.

Prior attempts to produce a hand-operated casting mold having multiple parallel channels of casting cavities have used a hinging device similar to the devices discussed prior. Exemplary of a scissor hinge solution to the problem in U.S. Pat. No. 3,749,351, Lee, which securely fastens an intermediate one of three mold blocks to the pivot pin of the hinge device itself while fastening the outer two blocks to the hinge jaws. This arrangement pivots the external mold blocks entirely out of contact with the intermediate block which is held fixed with respect to the hinge pivot. In thus entirely separating the adjacent mold blocks, the relative alignment between these three mold blocks is controlled solely by the hinge pivot itself until the mold blocks are brought into intimate contact.

A disadvantage of this arrangement is that many manufacturing tolerances or wear between the hinge pivot journals and bearings will allow the mold blocks to move out of registry with each other when the mold is opened. Upon closing the mold, the out of registry blocks are forced into alignment by various devices located between the opposing faces of the adjacent blocks. However, the potential for damaging the opposing faces of adjacent blocks by forcing the blocks into registry when the opposing faces of adjacent blocks are essentially in contact is very great. Once the opposing faces have been damaged, the mold is useless until it is re-conditioned. Any surface irregularities or burrs on a damaged mold block face will prevent an intimate contact between that face and an adjacent mold block face which will result in air space between the mold blocks. This air space will become filled with bullet metal during casting and the resultant bullets which are cast will be useless for their intended purpose to the presence of the fins of bullet metal which have solidified in the air space between the mold blocks adjacent the casting cavities.

SUMMARY OF THE INVENTION

It is, therefore, a primary object of the present invention to disclose and provide a multiple cavity bullet mold having multiple adjacent parallel rows of casting cavities which will permit the production of large quantities of bullets with a minimum of operator fatique.

It is a further object of the present invention to disclose and provide improved means for pivoting adjacent mold blocks out of contact with each other in order to allow the bullets as cast to fall from the casting cavities.

It is a further object of the present invention to disclose an provide improved alignment means for retaining a continuous surface contact between at least a portion of the opposing lateral surfaces of adjacent blocks and for retaining at least a portion of the opposing lateral surfaces of adjacent blocks in registry at all times during opening and closing of the mold.

Generally stated, the present invention in improved bullet molds having a plurality of adjacent mold blocks includes the provision of interlocking means at least partially integral of the adjacent blocks for providing a sliding surface contact for the blocks during pivotal movement of the blocks. The interlocking means limits relative movement between the blocks to arcuate separation and closure of the adjacent blocks within a plane perpendicular to the opposing lateral surfaces of the blocks.

Additionally, means integral of the opposing lateral surfaces provide at least one pivot center of arcuate separation and closure between the adjacent blocks.

Additionally, means are provided for retaining at least a portion of the opposing lateral surfaces of the adjacent blocks in contact during the arcuate separation and closure of the blocks. A more complete understanding of the improvement in bullet molds in accordance with the present invention, as well as recognition of additional objects and advantages therefor, will be afford to those skilled in the art from a consideration of the following detailed description of an exemplary embodiment thereof. Reference will be made to the appended sheet of drawings which will first be discussed briefly.

BRIEF DESCRIPTION OF THE DRAWINGS

FIG. 1 a partial side-sectional view of an improved bullet mold in accordance with the present invention;

FIG. 2 is a partial sectioned plan view of an improved bullet mold in accordance with the present invention showing the relationship between the adjacent mold blocks;

FIG. 3 is a sectional view through the plane III—III of FIG. 1;

FIG. 4 is a sectional view through the plane IV—IV of FIG. 1;

FIG. 5 is a partial plan view of the bullet mold of FIG. 2 showing the cut-off means rotated away from the casting cavities after having removed excess material from the finished bullets and the adjacent mold blocks separated to allow the bullets as cast to fall from the casting cavities;

FIGS. 6 and 6*a* are detail views showing an alignment plate associated with the interlocking means of the present invention and mounting means therefor; and FIG. 7 is a view similar to that shown in FIG. 3 showing a further exemplary embodiment for interconnecting the plurality of mold blocks and is viewed through a plane parallel to the plane III—III of FIG. 1.

DETAILED DESCRIPTION OF AN EXEMPLARY EMBODIMENT

Referring first to FIGS. 1 and 2, a mold for casting bullets is shown which comprises a plurality of adjacent mold blocks 1*a*, 1*b*, and 1*c*. Paired opposing cavity portions represented at 3*a* and 3*b* in FIG. 2 are formed within opposing lateral surfaces 5*a* and $5b_1$ of mold blocks 1*a* and 1*b* respectively to form casting cavities 4 within the mold when the mold is closed and when the opposing lateral surfaces $5a/5b_1$, and $5b_2/5c$ are in contact as is shown in FIG. 2.

Cut-off means 10 which is rotatably moveable in a plane parallel to the top surface of the mold blocks 1*a*, 1*b*, and 1*c* and perpendicular to opposing lateral surfaces 5*a*, $5b_1$, $5b_2$ and 5*c* is provided with apertures, representatively shown at 12, therethrough for permitting the introduction of molten material into the bullet casting cavities 4. Each aperture 12 is provided with a cutting edge 13 as is shown in FIG. 1 which removes excess material from the base of the finished bullets as cast. It should be noted that apertures 12 are arranged in two parallel rows and correspond 1:1 to casting cavities 4 when the mold is closed and cut-off means 10 is positioned as in FIG. 2.

In operation, molten material, i.e. lead, is introduced into recess channels 11*a* and 11*b* which connect each of the apertures 12 in their respective rows. The molten material flows through the apertures into the casting cavities where it solidifies as is shown at 9 in FIG. 4. The bullet as cast 9*b* is connected through aperture 12 to the solidified excess material 9*a* as is shown in FIG. 4. In order to provide a usable bullet with a flat base, a firm blow to striker 16 will pivot cut-off means 10 about shaft 40 from the position shown in FIG. 2 to the position shown in FIG. 5. As cut-off means 10 rotates, cutting edges 13 sever the excess material 9*a* from the base of the bullets to provide a flat finished surface. The mold is then opened by means of handles 2*a* and 2*c* to the position shown in FIG. 5 and the finished bullets are allowed to drop from the casting cavities 4. The mold then closed and cut-off means 10 is returned once again to the position shown in FIG. 2 which is controlled by the interaction of positioning stop 14 and recess 14*a*. At this point, more molten material is poured into recess channels 11*a* and 11*b* and the operational cycle is repeated.

To retain cut-off means 10 in contact with the top surface of mold blocks 1*a*, 1*b*, and 1*c*, shaft 40 is extended through aperture 16 in cut-off means 10 then through aperture 6 in block 1*b* and into slot 21*b* therethrough. Shaft head 44 of shaft 40 contacts the top surface of cut-off means 10 and retains cut-off means 10 in contact with the top surface of mold blocks 1*a*, 1*b*, and 1*c* as is shown in FIGS. 1 and 3.

Pivot means are provided for connecting mold blocks 1*a*, 1*b*, and 1*c* and for permitting relative movement therebetween during operational cycling of the mold. Interlocking means at least partially integral of the adjacent mold blocks 1*a*, 1*b*, and 1*c*, provide a sliding surface contact for the blocks during pivotal movement thereof from the position shown in FIG. 2 to the position shown in FIG. 5. As may best be seen in FIGS. 1, 3, and 7, the interlocking means comprise means for providing individual slots 21*a*, 21*b*, and 21*c* in each of mold blocks 1*a*, 1*b*, and 1*c* respectively. Individual slots 21*a*, 21*b*, and 21*c* provide a continuous aligned relief 21 across a portion of the mold when mold blocks 1*a*, 1*b*, and 1*c* are closed and in registry as shown in FIGS. 1 and 2. The continuous relief 21 provided by individual slots 21*a*, 21*b*, and 21*c*, receives an associated alignment plate means 22 which guides the plurality of blocks into registry as the mold is closed. Alignment plate means 22 is retained within the continuous relief provided individual slots 21*a*, 21*b*, and 21*c* by means of shaft 40 which is rotatably mounted within aperture 6 in mold block 1*b* and which extends through the aperture into individual slot 21*b* of the block. Shaft 40 engages alignment plate means 22 and, as may be seen in the exemplary embodiments shown in FIGS. 1, 3, and 6, a threaded interconnection between threaded portion 41 of shaft 40 and threaded aperture 24 of alignment plate 22 provide a positive retention of alignment plate means 22 within continuous aligned relief 21.

In a first exemplary embodiment of the present invention shown in FIG. 3, bias means 50 and 150 interconnect mold blocks 1*a*, 1*b*, and 1*c* and generally urged the mold into a closed configuration, as seen in FIG. 2, with opposing lateral surfaces $5a/5b_1$ and $5b_2/5c$ of adjacent mold blocks 1*a*/1*b* and 1*b*/1*c* respectively in contact. As shown in FIGS. 2, 3 and 5, bias means 50 and 150 comprise helical springs which are mounted and tensioned between external mold blocks 1*a* and 1*c*. Apertures 7 and 107 extending through the mold receive helical springs 50 and 150 respectively and retainer pins 51*a* and 51*c* are then inserted through terminal loops 52*a*/52*c* and 152*a*/152*c* of helical springs 50 and 150 respectively and prevent the helical springs from being drawn into their respective apertures. This provides a tensioning of the springs and a resultant biasing and urging of the mold blocks into a closed configuration. When the mold is opened, helical springs 50 and 150 are extended as in FIG. 5, increasing the tension therein and increasing the biasing force which will tend to urge the mold blocks into the closed configuration shown in FIG. 2 when handles 2*a* and 2*c* are released.

In a second exemplary embodiment shown in FIGS. 6*a* and 7, helical springs 50 and 150 are replaced by mounting shafts 53*a* and 53*c* which extend through apertures 54*a* and 54*c* in mold blocks 1*a* and 1*c* respectively to engage slots 55*a* and 55*c* in modified alignment plate means 122 to retain alignment plate means 122 within continuous aligned relief 21 while, at the same, not interfering with the arcuate separation of the mold blocks.

Means integral of the opposing lateral surfaces $5a/5b_1$ and $5b_2/5c$ provide at least one pivot center of arcuate separation and closure between adjacent blocks 1*a*/1*b* and 1*b*/1*c* respectively. As may be seen in FIGS. 2 and 5, mold blocks 1*a* and 1*c* are relieved to provide pivot shoulders 27*a* and 27*c* on lateral surfaces 5*a* and 5*c* respectively and, as mold blocks 1*a*/1*b* and 1*b*/1*c* are separated as shown in FIG. 5, pivot shoulders 27*a* and 27*c* each provide a pivot center of arcuate separation and closure adjacent blocks 1*a*/1*b* and 1*b*/1*c* respectively.

As may be seen by the foregoing discussion, at least a portion of opposing lateral surfaces $5a/5b_1$ and $5b_2/5c$ of adjacent blocks 1*a*/1*b* and 1*b*/1*c* are retained in contact at all times during the arcuate separation and closure of the blocks. Pivot shoulders 27*a* and 27*b* contact lateral surfaces $5b_1$ and $5b_2$ of mold block 1*b* at all times during the arcuate separation of the blocks and, upon closing the mold as in FIG. 2, the entire remaining surface areas of lateral surfaces $5a/5b_1$ and $5b_2/5c$ are in contact.

In addition to alignment plate means 22, alignment pin means 30 extends beyond lateral surfaces $5b_1$ and $5b_2$ for engaging cooperative recesses 31*a* and 31*c* within opposing lateral surfaces 5*a* and 5*c* respectively. In thus providing alignment pin means which extend beyond one of each pair of the opposing lateral surfaces for engaging a cooperative recess within the other opposing lateral surface of the pair, a secondary alignment of mold blocks 1*a*, 1*b* and 1*c* is provided. In order to assure that the mold blocks are in registry over their entire length, it is desirable to have alignment pin means 30 and cooperative recesses 31*a* and 31*c* located at a distal portion, relative to individual slots 21*a*, 21*b* and 21*c*, in each of the mold blocks 1*a*, 1*b*, and 1*c* respectively as is shown in FIGS. 1 and 2.

From the foregoing discussion, it may be seen that as the mold blocks are returned to the closed position shown in FIG. 2, alignment pin means 30 will be guided into cooperative recesses 31*a* and 31*c* and, as the mold is closed completely, mold blocks 1*a*, 1*b* and 1*c* will be guided into registry as may be seen in FIG. 4.

Having thus describe an exemplary embodiment of an improved mold for casting bullets, it should be understood by those skilled in the art that various alternatives and modifications thereof may be made within the scope and spirit of the present invention which is defined by the following claims.

I claim:

1. In a mold for casting bullets comprising a plurality of adjacent mold blocks having paired opposing cavity portions within opposing lateral surfaces of adjacent blocks for forming casting cavities when said mold is closed and said opposing lateral surfaces are in contact, cut-off means moveable in a plane perpendicular to said opposing lateral surfaces of said adjacent blocks having apertures therethrough for permitting introduction of molten material into said casting cavities and for removing excess material from the finished bullets as cast and pivot means for connecting said blocks and permitting relative movement therebetween, the improvement comprising:

interlocking means comprising individual slots in each of said plurality of blocks, said individual slots providing a continuous aligned relief across a portion of said mold when said plurality of blocks is in registry, and receiving associated alignment plate means for guiding said plurality of blocks into registry as said mold is closed;

means integral of said opposing lateral surfaces cooperating about a pivot center to provide arcuate separation and closure between said adjacent blocks; and means extending through said adjacent mold blocks for retaining at least a portion of said opposing lateral surfaces of said adjacent blocks in contact during the arcuate separation and closure of said blocks.

2. In the mold of claim 1, the improvement of interlocking means comprising:

alignment pin means extending beyond one of each pair of said opposing lateral surfaces for engaging a cooperative recess within the other opposing lateral surface of said pair.

3. The mold of claim 2, wherein:

said alignment pin means and cooperative recess are located at a distal position, relative to said individual slots, in each of said plurality of blocks.

4. The mold of claim 1, the improvement in interlocking means comprising:

mounting means on said blocks for retaining said associated alignment plate means within said continuous aligned relief as said mold is opened and closed.

5. The mold of claim 4, the improvement in mounting means comprising:

shaft means, rotatably mounted within an aperture in one of said plurality of blocks and extending through said aperture into said individual slot of said block, for engaging said alignment plate means.

6. The mold of claim 5, the improvement in mounting means comprising:

means providing a threaded interconnection between said shaft means and said alignment plate means.

7. The mold of claim 1, the improvement comprising:

bias means interconnecting said plurality of blocks for urging said mold into a closed configuration with said opposing lateral surfaces of adjacent blocks in contact.

8. The mold of claim 7, the improvement in bias means comprising:

mounting means on said blocks for mounting said bias means tensioned between external ones of said plurality of blocks.

9. The mold of claim 7, the improvement in bias means comprising:

aperture means extending through said mold for receiving said bias means.

10. The mold of claim 9, wherein said bias means comprises a helical spring.

* * * * *